US005997256A

United States Patent [19]

Gunther

[11] Patent Number: 5,997,256

[45] Date of Patent: Dec. 7, 1999

[54] DUAL STAGE, DUAL MODE AIR PUMP

[75] Inventor: John A. Gunther, Redwood City, Calif.

[73] Assignee: Bell Sports, Inc., San Jose, Calif.

[21] Appl. No.: 09/151,170

[22] Filed: Sep. 10, 1998

[51] Int. Cl.[6] ..... F04B 3/00

[52] U.S. Cl. ..... 417/259; 417/440; 417/528; 417/530; 417/534; 417/555.1

[58] Field of Search ..... 92/58.1; 417/530, 417/523, 555.1, 535, 525, 528, 440, 259

[56] References Cited

U.S. PATENT DOCUMENTS

| | | | |
|---|---|---|---|
| 5,435,703 | 7/1995 | Lin | 417/428 |
| 5,676,529 | 10/1997 | Hermansen et al. | 417/259 |
| 5,759,018 | 6/1998 | Thanscheidt | 417/531 |

*Primary Examiner*—Charles G. Freay
*Assistant Examiner*—Ehud Gartenberg
*Attorney, Agent, or Firm*—Robert O. Guillot

[57] ABSTRACT

The dual stage, dual mode air pump is selectively operable in a low pressure, high volume mode or a high pressure, low volume mode. It includes a pump head, an outer tube that is engaged to the pump head, an inner tube that is engaged to the pump head and a middle tube that is slidably engaged to both the outer tube and the inner tube. A mode pump switch is utilized to allow the pump operator to change the mode of the pump. In the preferred embodiment, the mode switch is disposed within the pump head. It includes an air passageway having a manually switchable valve disposed therein. In the high volume, low pressure mode the valve switch is closed, whereupon pumped air passes into a pneumatic article engaged to the end of the pump. When the valve switch is opened, the pump is operable in the low volume high pressure mode, and a portion of the pumped air is outletted into the ambient environment, rather than being pumped into the pneumatic article. Additionally, the pump includes multiple chambers, such that a pump chamber is prepressurized on a pump backstroke to increase the air throughput of the pump.

26 Claims, 10 Drawing Sheets

DUAL STAGE, DUAL MODE AIR PUMP

BACKGROUND OF THE INVENTION

1. Field of the Invention

The present invention relates generally to manually operated air pumps, such as bicycle pumps, and more particularly to manually operated pumps having a low pressure mode and a high pressure mode.

2. Description of the Prior Art

The operator of a manual air pump, such as a bicycle tire pump, generally encounters two difficulties in pumping a pneumatic article as a tire to a high pressure, such as more than 100 psi. Firstly, when commencing the pumping process, the article has a low (ambient) pressure and it is desirable to pump as large a volume of air into the article with each pumping stroke. The operator's difficulty at this stage is that many pumping strokes are required unless the volume of air per stroke is large. Secondly, when the article approaches a relatively high pressure, perhaps in excess of 80 psi, the operator generally encounters difficulty in pumping further air into the article due to the force required. In this stage of the pumping operation, it is desirable for the pump to have a relatively narrow bore, such that the force required of the operator to operate the pump is manageable. Therefore, dual mode manual pumps have been developed which operate in two modes, a low pressure, high volume mode and a high pressure, low volume mode.

Additionally, pumps have been developed that operate in two stages. In a first pump stare on a pump backstroke, air is pumped from a first chamber into a second pump chamber to prepressurize the air in the second pump chamber. Then, on a compression stroke, the prepressurized air in the second chamber is pumped into the tire. Such dual stage pumps therefore pump more air into a tire per stroke than a single stage pump. The present invention includes both types of pump features, and is thus a dual stage, dual mode pump.

SUMMARY OF THE INVENTION

The dual stage, dual mode air pump is selectively operable in a low pressure, high volume mode or a high pressure, low volume mode. It includes a pump head, an outer tube that is engaged to the pump head, an inner tube that is engaged to the pump head and a middle tube that is slidably engaged to both the outer tube and the inner tube. A mode pump switch is utilized to allow the pump operator to change the mode of the pump. In the preferred embodiment, the mode switch is disposed within the pump head. It includes an air passageway having a manually switchable valve disposed therein. In the high volume, low pressure mode the valve switch is closed, whereupon pumped air passes into a pneumatic article engaged to the end of the pump. When the valve switch is opened, the pump is operable in the low volume high pressure mode, and a portion of the pumped air is outletted into the ambient environment, rather than being pumped into the pneumatic article. Additionally, the pump includes multiple chambers, such that a pump chamber is prepressurized on a pump backstroke to increase the air throughput of the pump.

It is an advantage of the present invention that it provides a dual mode pump that is easy to operate.

It is another advantage of the present invention that it provides a dual stage pump that is easy to operate.

It is a further advantage of the present invention that it provides a dual stage, dual mode pump that is easy to operate.

It is yet another advantage of the present invention that it provides a dual stage, dual mode pump that is simple to manufacture and assemble.

It is yet a further advantage of the present invention that it provides a dual mode pump having a mode switch that is easy to operate.

It is still another advantage of the present invention that it provides a dual mode pump having a two valve outer housing, and wherein the mode switch is operable by rotation of the two valve outer housing.

These and other features, objects and advantages of the present invention will become apparent upon reading the following detailed description of the preferred embodiments in conjunction with the several figures of the drawings.

IN THE DRAWINGS

DETAILED DESCRIPTION OF THE PREFERRED EMBODIMENTS

The pump of the present invention is a manually operated air pump such as is utilized for pumping up bicycle tires. The general principles of the pump 10 may be applied to both hand operated pumps and floor standing pumps, as are known to those skilled in the art. As is discussed in detail herebelow, the pump 10 may be configured in two modes. The first mode is a high volume low pressure mode. In this user selectable mode, the pump provides a relatively large volume of air on each compression stroke, and relatively low force is required to operate the pump. Users of pumps know that as the pneumatic article, such as a bicycle tire, becomes full due to pumping, the pressure in the tire rises and the user must exert greater and greater force upon the pump handle in the compression stroke to continue to pump further air into the tire. At a user selectable point in the pumping process, the user may then alter the mode of the pump 10 to become a high pressure, low volume pump. In this second mode, a smaller quantity of air is pushed into the tire on each compression stroke, however less force is required of the user to pump the air. This second mode enables the user to pump additional air into the tire, raising the air pressure within the tire, while applying less force to the pump compression stroke than was required in the first mode. Additionally, the pump includes multiple chambers, such that a pump chamber is prepressurized on a pump backstroke to increase the air throughput of the pump. The operational details of the pump 10 are next discussed with the aid of generalized pump depictions of FIGS. 1–8.

Figure 1:
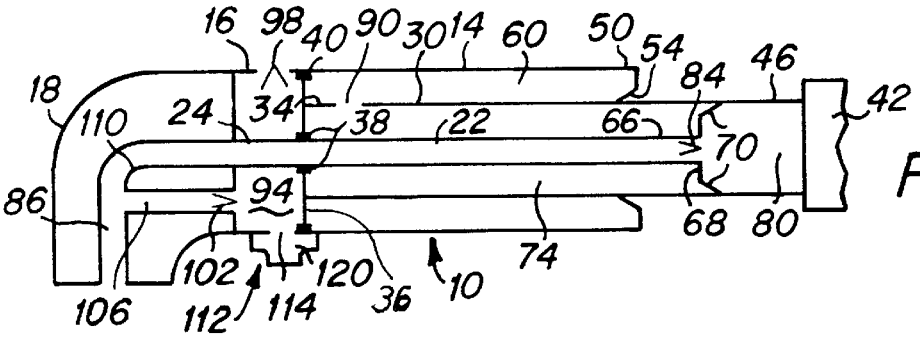
FIG. 1 is a representational side cross-sectional view generally depicting the operational characteristics of the pump of the present invention in a closed orientation and configured in a high air volume, low pressure mode.

As depicted in FIG. 1, the pump 10 includes a stationary outer tube 14 that is fixedly engaged at its inner end 16 to a pump head 18, and an inner tube 22 that is co-axially disposed relative to tube 14 and is also fixedly engaged at its inner end 24 to the pump head 18. The pump 10 further includes a movable middle tube 30 that is co-axially disposed relative to the inner tube 22 and outer tube 14. The inner end 34 of the middle tube 30 includes a piston member 36 which makes a slidable air tight seal 38 with the inner tube 22 and a slidable air tight seal 40 with the outer tube 14, and a handle 42 is engaged to the outer end 46 of the middle tube 30. The outer end 50 of the outer tube 14 includes a one-way air valve 54 which slidably engages the middle tube 30 and permits air to pass into an outer air chamber 60 disposed between the walls of the outer tube 14 and the middle tube 30. The outer end 66 of the inner tube 22 includes a piston member 68 having a one-way valve 70 which slidably engages the inner wall of the middle tube 30, such that air from a middle air chamber 74 disposed between the walls of the middle tube 30 and the inner tube 22 can flow into the high pressure air chamber 80 enclosed by the walls of the middle tube 30 exterior of the inner tube 22. A further one-way air valve 84 is disposed in the piston 68 at the outer end 66 of the inner tube 22 to permit air to flow from the high pressure chamber 80 into the inner tube 22 and thereafter through air passageway 86 when the pump 10 is operated in a compression stroke, as described herebelow.

An air flow passageway, such as an opening 90 formed in the wall of the middle tube 30, facilitates air transfer between the outer air chamber 60 and the middle air chamber 74, as is necessary for pulp operation, as will be understood from the discussion of the pumps operational characteristics herebelow. Preferably, the total expanded volume of chambers 60 plus 74 is significantly greater than the expanded volume of chamber 80, such that when air is transferred from chambers 60 and 74 into chamber 80, it is significantly prepressurized owing to the smaller volume of expanded chamber 80.

A low pressure air chamber 94 is formed proximate the pump head 18 between the outer tube 14 and the inner tube 22. An air inlet passageway, such as one-way valve 98, is formed in the outer tube 14 proximate the inner end 16 to permit ambient air to enter the chamber 94, and a second one-way valve 102 is formed in the pump head 18 to permit air to be pumped from the chamber 94 into an air passageway 106 in the pump head 18 which intersects pneumatically with the air passageway 110 of the inner tube 22 through the pump head 18. A mode selection switch 112 is operably connected with the chamber 94 to selectively permit air within chamber 94 to be outletted into the passageway 102 or into the ambient environment. In the embodiment depicted in FIGS. 1–8, a mode selection orifice 114 is formed through the wall of the outer tube 14, and a mode selection member 120 is movably engaged to the outer tube 14 to selectably cover the orifice 114, whereby the pumping mode of the pump 10 is selectably altered by the user.

Figure 2:
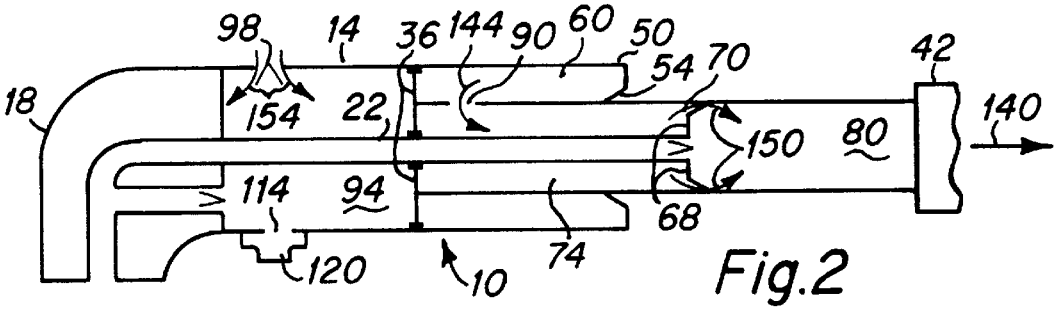
FIG. 2 depicts the pump of FIG. 1 wherein the handle is being extended.

FIG. 2 depicts a first step in the operation of the pump 10, wherein the handle 42 is pulled outwardly (see arrow 140). When the handle 42 is pulled outwardly the middle tube 30 is likewise pulled outwardly relative to the stationary outer tube 14 and inner tube 22. As the handle 42 is pulled outwardly, chamber 80 increases in volume whereas outer chamber 60 and middle chamber 74 decrease in volume because the slidable piston 36 is moved toward the outer end 50 of the outer tube 14. Air from the outer chamber 60 travels 144 through the passageway 90 and into the middle chamber 74, and air from the middle chamber 74 travels 150 past the one-way valve 70 into the chamber 80. Thus, nearly all of the air in chambers 60 and 74 travels into chamber 80 during the outward handle extending stroke depicted in FIG. 2. Because the total expanded volume of chambers 60 plus 74 is greater than the expanded volume of chamber 80, the air in chamber 80 is prepressurized on the outward pulling stroke of handle 42. Preferably, the total expanded volume of chambers 60 plus 74 is approximately twice that of chamber 80, such that chamber 80 is prepressurized to approximately twice ambient pressure on the handle extension stroke depicted in FIG. 2. Meanwhile, chamber 94 is increased in volume by the outward movement of the slidable piston 36 and air travels 154 through the one-way valve 98 into the chamber 94.

Figure 3:
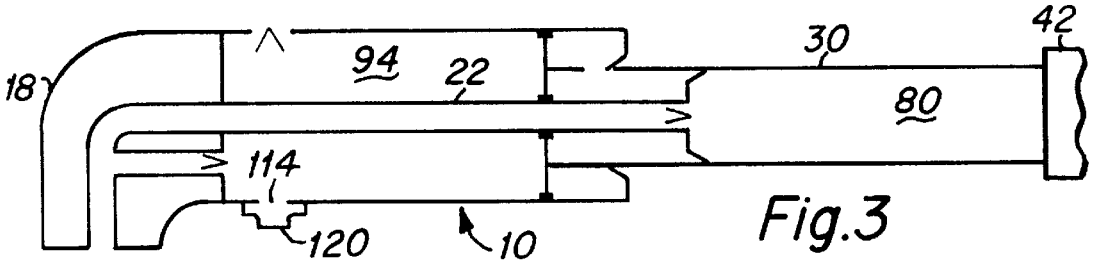
FIG. 3 depicts the pump of FIG. 1 wherein the handle is fully extended.

FIG. 3 depicts the pump 10 with a fully extended handle 42, such that the middle tube 30 is fully extended rearwardly. Chamber 80 is full of prepressurized air and chamber 94 is likewise full of ambient pressure air.

Figure 4:
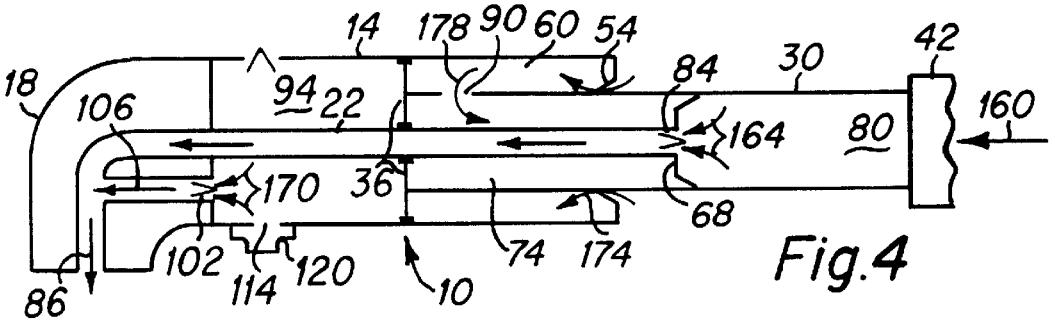
FIG. 4 depicts the pump of FIG. 1 wherein the handle is being compressed.

FIG. 4 depicts the compression stroke of the pump 10, wherein the handle 42 is pushed (arrow 160) inwardly toward the pump head 18. Air in chamber 80 is pushed 164 through one-way valve 84 into and through the inner tube 22 and through the air passage 86 in the pump head 18, and ultimately into the pneumatic object (such as a tire) to which the pump head 18 is attached. The compression 160 of the handle 42 also compresses chamber 94 through the inward motion of piston 36, such that air in chamber 94 is pushed 170 through one-way valve 102 into passageway 106 and thence into passageway 86 whereupon it also travels out of the pump head 18 and into the pneumatic object. As the handle 42 is compressed 160, outer chamber 60 and middle chamber 74 increase in volume and air travels 174 through one-way seal 54 into chamber 60 and through 178 passageway 90 into the middle chamber 74. It is therefore to be understood that on the compression stroke 160 depicted in FIG. 4, air from both chambers 80 and 94 is pumped through the pump head 18 and into the pneumatic object attached to head 18. When the compression stroke 160 is complete, the pump 10 assumes the configuration depicted in FIG. 1. Thereafter, as pumping stroke are repeated by the user, air is continually pumped on compression strokes 160 (FIG. 4) into the pneumatic object engaged to the pump head 18. As indicated hereabove, when the air pressure in the pneumatic object rises to a user selected point of increased pumping difficulty, the mode switch 120 may be moved to open the passageway 114 in the outer tube 14, and the pump may be thereafter operated by the user in the imanner depicted in FIGS. 5–8, as is next discussed.

Figure 5:
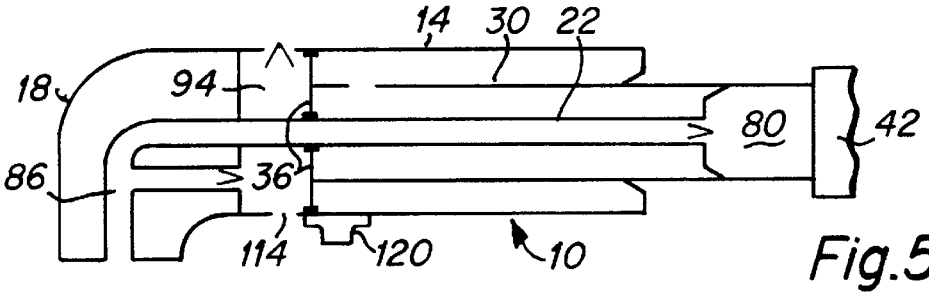
FIG. 5 depicts the pump of FIG. 1 in a collapsed configuration wherein the pump is configured in the high pressure, low volume mode.
Figure 6:
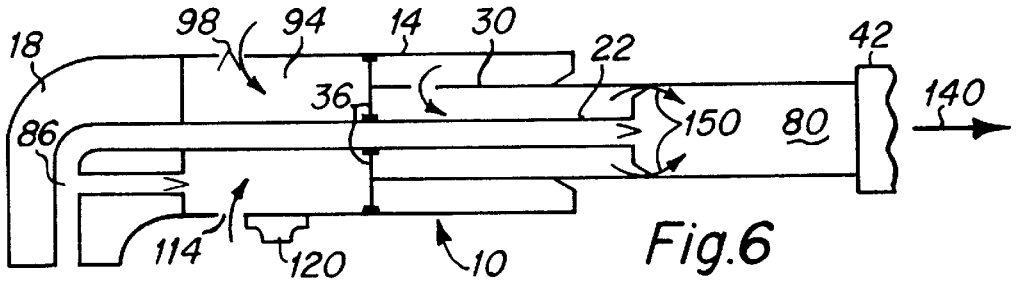
FIG. 6 depicts the pump of FIG. 5 wherein the handle is being extended.
Figure 7:
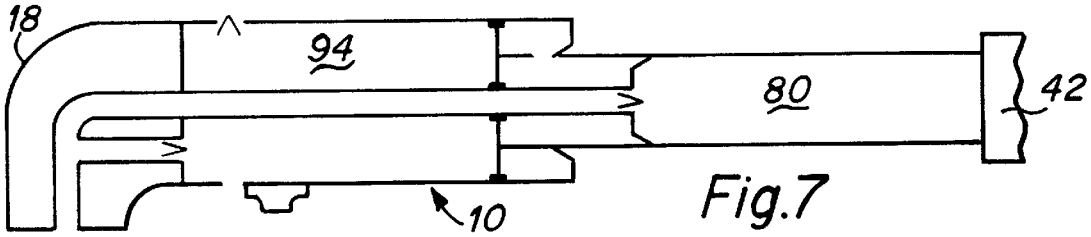
FIG. 7 depicts the pump of FIG. 5 wherein the handle is fully extended.

As depicted in FIG. 5, the pump 10 is in the collapsed configuration depicted in FIG. 1, however the mode switch 120 has been activated by the user, such that passageway 114 is open. All of the other components of the pump 10 remain identically situated, as depicted in FIG. 1 and described hereabove. Thereafter, as depicted in FIG. 6, the handle 42 is pulled outwardly (see arrow 140), such that chamber 80 increases in volume and air travels 150 into chamber 80 from the outer chamber 60 and middle chamber 74, such that chamber 80 is prepressurized, as discussed hereinabove. However, as chamber 94 expands in volume air travels 180 through passageway 114 as well as one way valve 98 to fill chamber 94. FIG. 7 depicts the pump 10 wherein the handle 42 is in its fully extended position and chambers 80 and 94 are expanded to their maximum volume.

Figure 8:
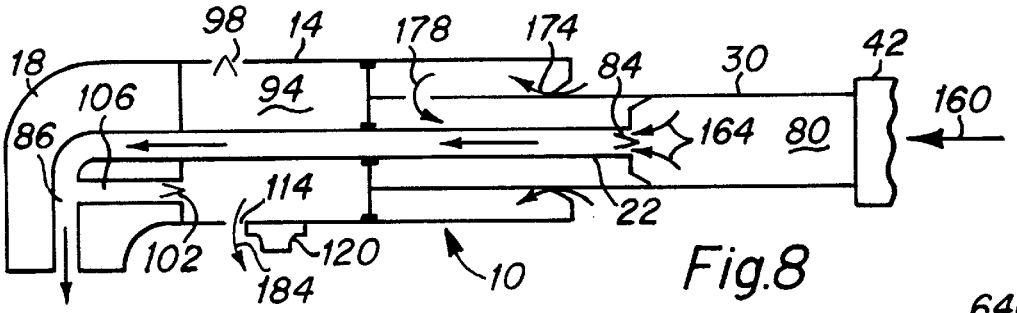
FIG. 8 depicts the pump of FIG. 5 wherein the handle is being compressed.

Thereafter, as depicted in FIG. 8, the handle 42 is pushed inwardly 160 in a compression stroke. As described hereabove, prepressurized air in chamber 80 is pushed 164 through one-way valve 84 into and through the inner tube 22 and through the air passage 86 of the pump head 18 and out. Significantly however, air in chamber 94 is pumped outwardly 184 through the open passageway 114 into the ambient environment. That is, the pump user does not have to apply the force necessary to push the air in chamber 94 through the one-way valve 102. Furthermore, the one-way valve 102 prevents high pressure air in passageway 106 and 86 from exiting into chamber 94 and outward through passageway 114. Thus, when the pump 10 is configured as depicted in FIG. 8, the user is pumping the prepressurized air disposed within chamber 80 into the pneumatic article engaged to the pump head 18. However, because chamber 80 is relatively narrow, the force required from the user to push the air in chamber 80 through valve 84 is relatively low. Stated another way, the relatively high air pressure of the pneumatic object attached to the pump head is pneumatically communicated to both one-way valves 102 and 84. When the mode switch 120 is configured as depicted in FIG. 8, the user is only required to apply force necessary to raise the air pressure in chamber 80 of the relatively narrow middle tube 30 to a sufficient level to overcome the pneumatic object air pressure communicated to one-way valve 84.

It is to be understood that the generalized pump configuration depictions of FIGS. 1–8 are provided to present a generalized understanding of the pneumatic valve operational features of the present invention. Next discussed is a detailed preferred embodiment of the pump invention that functionally incorporates the operational features depicted in FIGS. 1–8.

Figure 9:
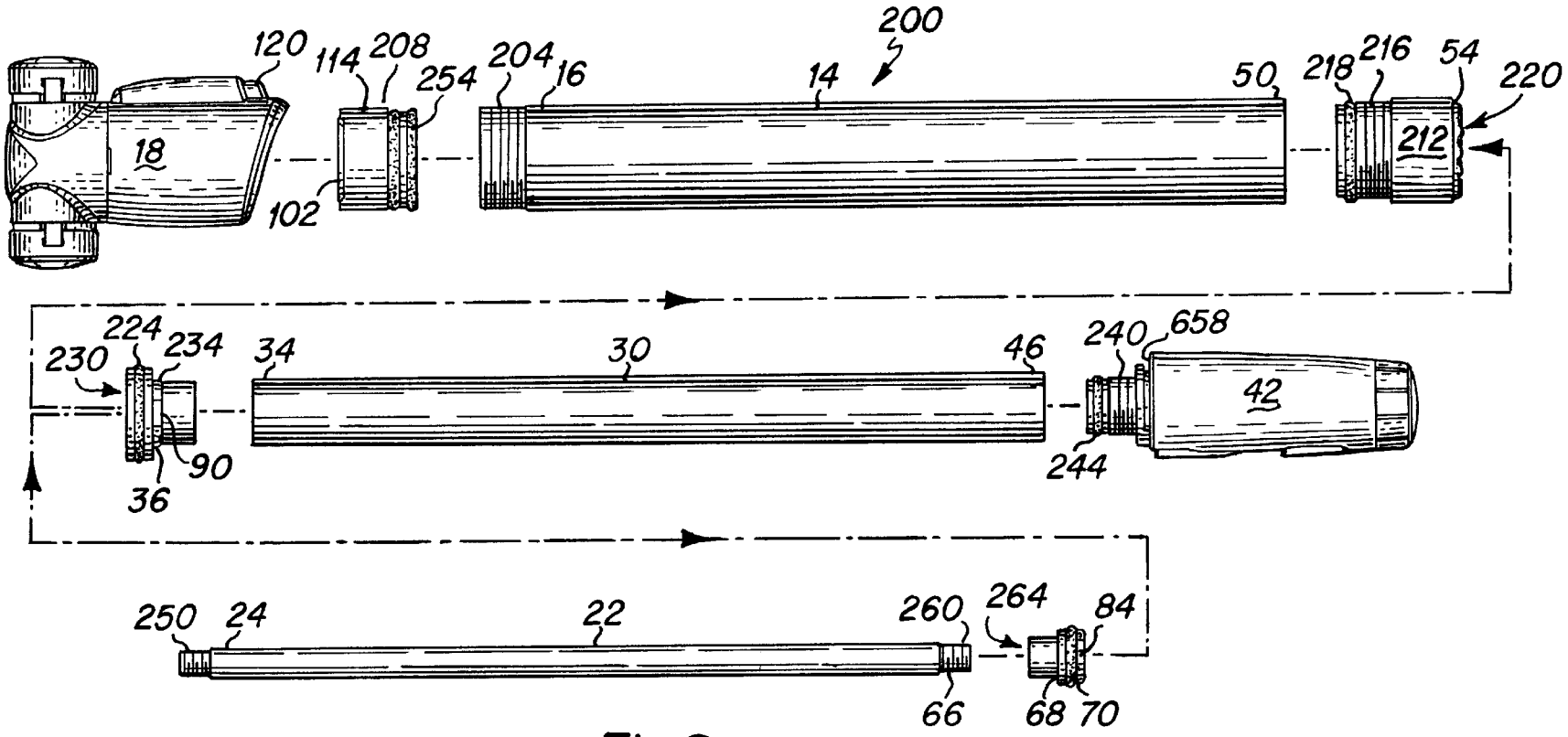
FIG. 9 is an assembly drawing of a preferred pump embodiment of the present invention.

FIG. 9 is an assembly drawing of a preferred pump embodiment 200 of the present invention and identical numbers are utilized to identify structures discussed hereinabove with regard to FIGS. 1–8. The pump 200 includes a pump head 18 including two user selectable output valve heads. A valve manifold member 208 is engaged within the pump head 18, and the mode switch 120 and the air passage 114 are disposed within the head 18 and manifold member 208, as is described in detail herebelow. The outer tube 14 has external threads 204 at its inner end 16 for threadable engagement with the pump head 18, and an outer tube end cap 212 is formed with external threads 216 and a sealing O-ring 218 for threadable engagement with internal threads (not shown) within the outer end 50 of the outer tube 14. The outer tube one-way valve 54 is disposed within the end cap 212, as is discussed in detail herebelow.

The middle tube 30 is slidably engagable within a bore 220 formed through the end cap 212 and within the outer tube 14. A middle tube piston member 36 is engaged to the inner end 34 of the middle tube 30. The piston member 36 includes an outer O-ring seal 224 forming a slidable air tight seal 40 with the inner surface of the outer tube 14, and an inner O-ring seal 230 (not shown) that forms a slidable air-tight seal 38 with the outer surface of the inner tube 22. An air passageway 90 is formed as a slot in a shoulder 234 of the piston member 36 to permit air from the outer air chamber 60 to flow into the middle tube 30. The handle 42 is formed with an externally threaded portion 240 and an O-ring seal 244 for a scaled threaded engagement with internal threads (not shown) formed in the outer end 46 of the middle tube 30.

The inner tube 22 is co-axially disposed within the middle tube 30. The inner end 24 of the inner tube 22 is formed with external threads 250 for threaded engagement within a threaded bore 254 formed within the manifold member 208. The outer end 66 of the inner tube 22 is formed with external threads 260 for threaded engagement within a threaded bore 264 formed within an inner tube piston member 68. The piston member 68 includes an outer one-way valve 70 that is slidably engagable with the inner surface of the middle tube 30, and an inner one-way valve 84 which permits air to travel into the outer end 66 of the inner tube 22, as has been discussed hereabove. The relative sizes of the outer tube 14, middle tube 30 and inner tube 22 are selected such that the total expanded volume of air chambers 60 plus 74 formed between the outer tube 14, middle tube 30 and inner tube 22 (as depicted in FIGS. 1–8 and described hereinabove) is approximately twice the expanded volume of chamber 80 disposed in the outer end of middle tube 30. Thus, the pump 200 functions as a dual stage pump. It is therefore to be understood that the plump 200 with its various valves and slidable seals described hereinabove, functions to pump air in the manner described hereabove with regard to FIGS. 1–8.

Figure 10:
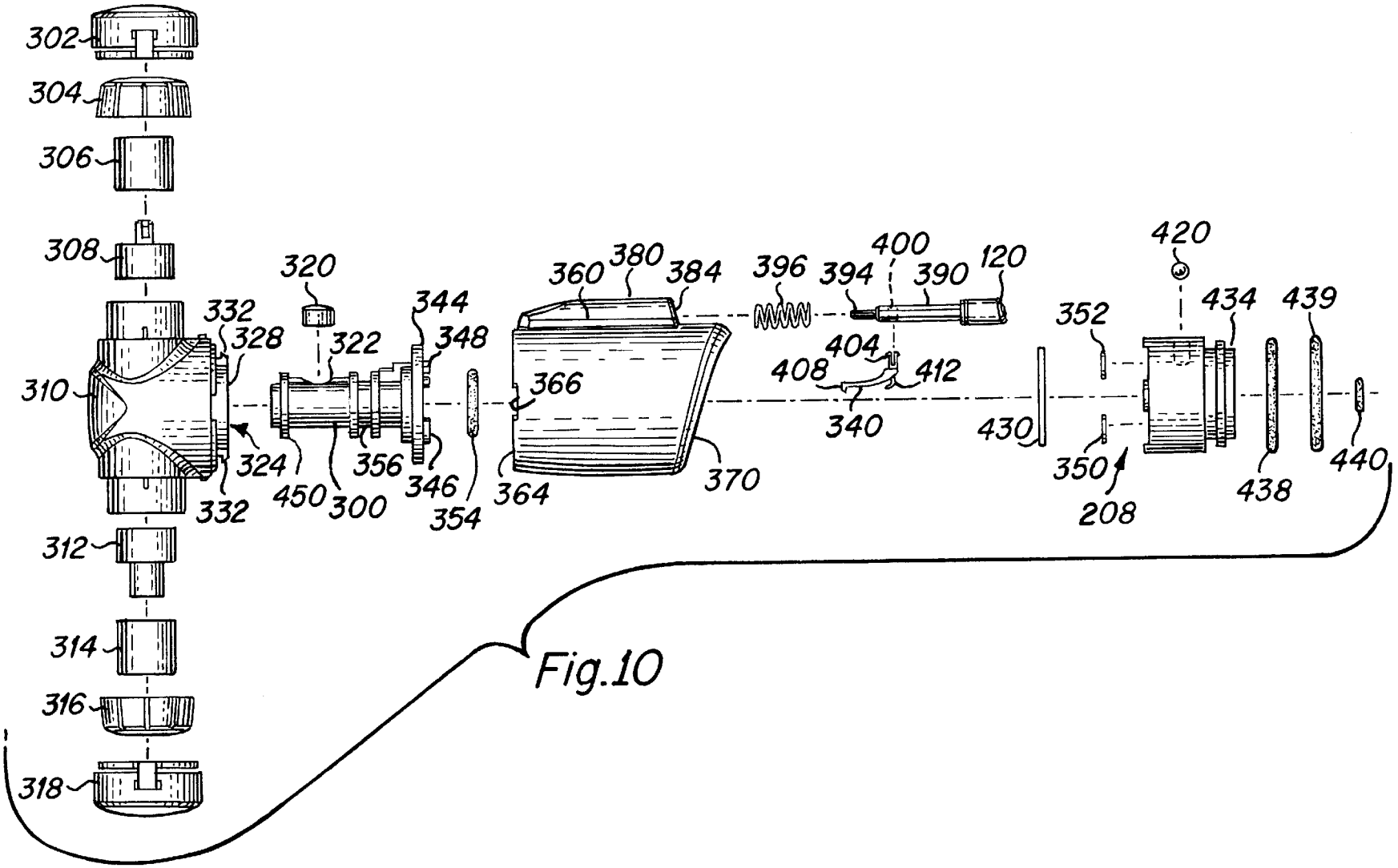
FIG. 10 is an assembly drawing of a pump head portion of the pump depicted in FIG. 9.

FIG. 10 is an assembly drawing depicting the components of the pump head 18 and manifold member 208. As depicted therein, the pump head 18 of the pump 200 is a two valve head that is rotatable upon a valve head spindle 300. The two valve head member includes a mud cap 302, a valve cap 304, a valve gasket 306, a Presta valve adaptor 308, a two valve outer housing 310, a Schrader valve adaptor 312, a valve gasket 314, a valve cap 316 and mud cap 318. Such a two valve head member is well known prior art. The valve spindle 300 includes a valve spindle seal 320 that is disposable within air port 322 formed in the spindle, and the valve spindle 300 resides within a spindle chamber 324 formed within the housing 310. An outwardly projecting flange 328 is formed on the rearward portion of the housing 310. The flange 328 includes two laterally projecting hook members 332 which are engagable by a movable hook switch 340 described more fully herebelow. The rearward surface 344 of the spindle 300 is disk shaped and includes two valve forming projections 346 and 348 that engage valve disks 350 and 352 respectively within the manifold 208. An O-ring 354 is disposed within a slot 356 within the spindle 300 to cushion the motion of the spindle within the housing 310.

A generally cylindrical valve head body member 360, having a generally cylindrical bore formed therethrough (as is discussed in detail herebelow), includes an valve housing engaging edge 364 having an air inlet slot 366 formed therein, and a rearward portion 370 having an internally threaded bore formed therein for threadable engagement with the external threads 204 of the outer tube 14. The valve body 360 includes a mode switch housing 380 formed on the external surface thereof, and the housing 380 includes a generally cylindrical bore 384 formed therein. A rod-like mode switch 120, having a cylindrical body portion 390 and a narrower cylindrical guide portion 394, is disposed for slidable engagement within the bore 384, and a mode switch spring 396 biases the mode switch 120 within the bore 384. A hook switch bore 400 is formed through the body portion 390 of the mode switch 120 and finger portions 404 of the hook switch 340 are designed to penetrate through the bore 400 to hold the hook switch 340 in engagement with the mode switch 120. The hook switch 340 includes a forwardly projecting hook end 408 and a ball engagement projection 412 for engagement with a ball valve 420 of the manifold member 208, as is discussed in detail herebelow. The projecting hook portion 408 of the hook switch 340 is designed for selectable engagement with the laterally projecting hook portions 332 of the flange portion 328 of the valve housing 310, as is further discussed herebelow. The valve manifold member 208 is co-axially disposed within the valve body 360 for fixed engagement with the inner end 344 of the spindle 300, and a flat gasket 430 is disposed between the manifold 208 and the spindle surface 344 to form an air tight seal therebetween, as is discussed in detail herebelow. The inner end 434 of the manifold 208 includes an O-ring seal 438 for forming an air tight seal with the inner surface of the inner end 16 of the outer tube 14, and an outer O-ring 439 that acts as a bumper for piston 36. A further O-ring seal 440 is disposed within an internally threaded central bore 254 (see FIG. 11) disposed within the manifold member 208 for forming an air tight seal with the inner end 24 of the inner tube 22. The manifold 208 includes air passages and valve housings for the functional operation of the pump 200, as are next discussed with the air of FIG. 11.

Figure 11:
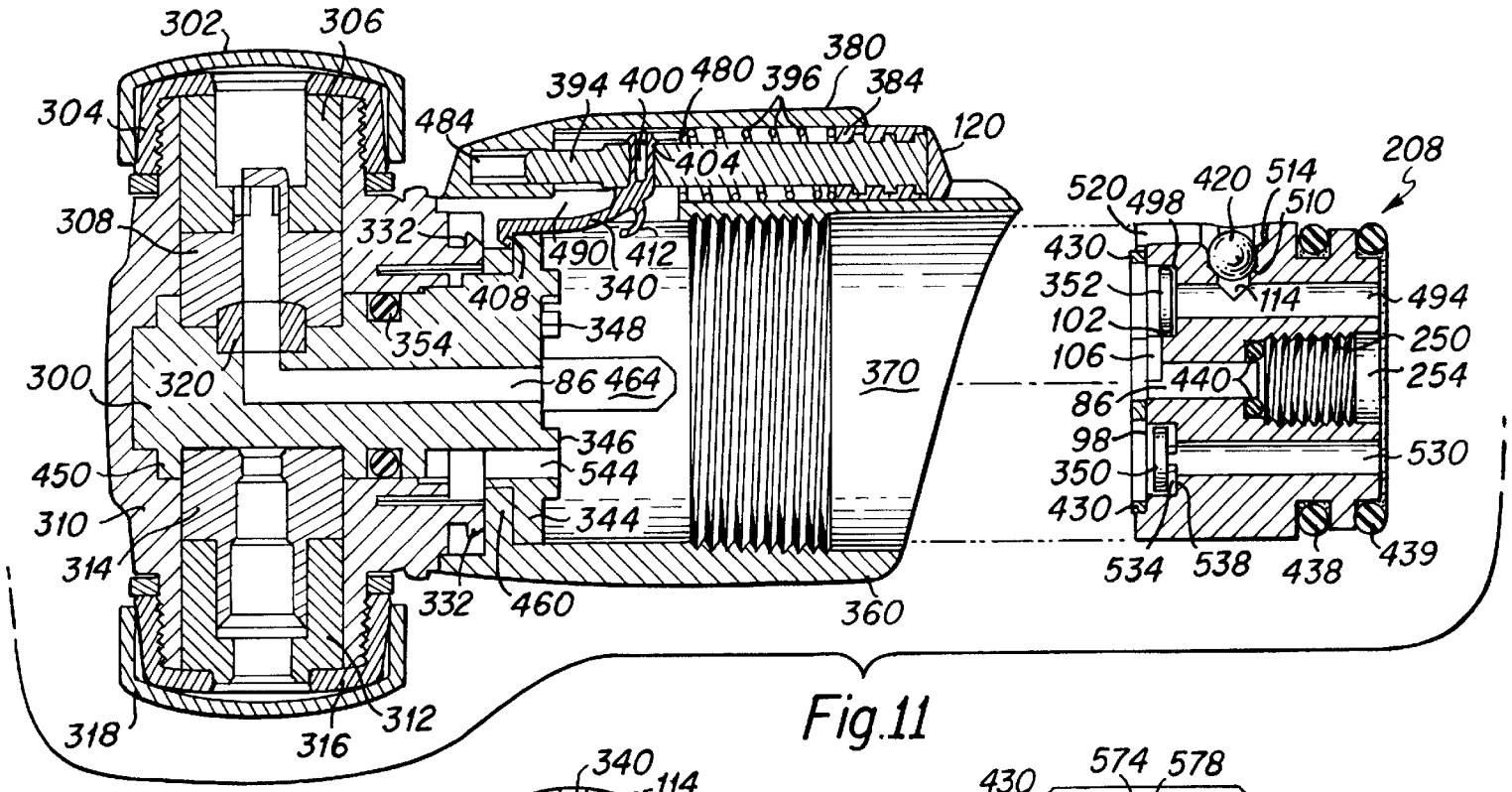
FIG. 11 is a side cross-sectional view of the pump head depicted in FIG. 10.

FIG. 11 depicts a cross-sectional partially assembled view of the pump head 18 of the pump 200. The pump head housing 310 is rotatably engaged to the spindle 300 through the insertion of the Presta valve adaptor 308 and Schrader valve adaptor 314 behind a projecting outer shoulder member 450 of the spindle 300. Thus, the dual valve head housing 310 is rotatable around the spindle 300, whereby the air channel 86 through the spindle 300 may selectively expel pumped air through either the Schrader valve or the Presta valve. The valve seal 320 forms an air tight seal with either the Schrader valve adaptor 314 or the Presta valve adaptor 308.

The spindle 300 is inserted within the bore 370 of the valve head body 360 such that the projecting shoulder 344 of the spindle 300 engages an inwardly projecting shoulder 460 of the valve body 360. An inwardly projecting alignment rib 464 of the body 360 is formed on the inner surface of the bore 370 to slidably mate with a notch (not shown) cut into the projecting shoulder 344 of the spindle 300 to align the spindle 300 and to prevent rotation of the spindle 300 relative to the body 360. The projecting rib 364 also slidably mates with a notch 550 (see FIG. 12) formed in the external surface of the manifold 208 to align and prevent rotation of the manifold 208 within the body 360, as is discussed herebelow.

As depicted in FIG. 11, the mode switch 120 resides within the bore 384 of the mode switch housing 380. The bore 384 includes spring stop ribs 480 against which the inner portion of the spring 396 rests, and the bore 384 includes an inner narrowed portion 484 within which the narrow guide portion 394 of the mode switch 120 is slidably engaged. The fingers 404 of the hook switch 340 are disposed within the bore 400, and a hook switch slot 490 is fornmed within the outer wall of the bore 370 to permit the axial motion of the hook switch 340 when the mode switch 120 is depressed forwardly towards the housing 310. As depicted in FIG. 11, the extended hook end 408 of the hook switch 340 is mechanically/frictionally engaged upon the outwardly projecting shoulder 344 of the spindle 300. In this configuration, the engagement of the hook 404 serves to prevent the mode switch 120 from sliding rearwardly out of the bore 384. It is further to be appreciated that the inward motion of the mode switch 120 will cause the hook 404 to engage the radially projecting flange hook 332 of the rearward flange 328 of the valve body head 310. In this inwardly disposed orientation of the mode switch 120, the valve ball engagement member 412 becomes disengaged from the valve ball 420, as will be understood from the description that follows.

Figure 13:
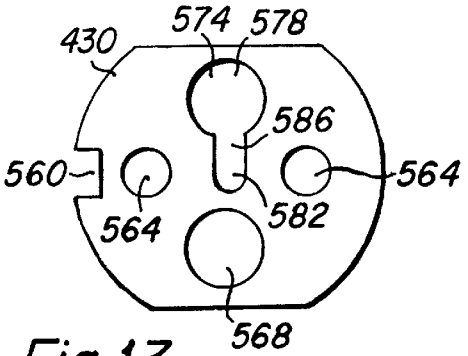
FIG. 13 is an elevational view of the pump gasket of the pump head depicted in FIG. 11.
Figure 12:
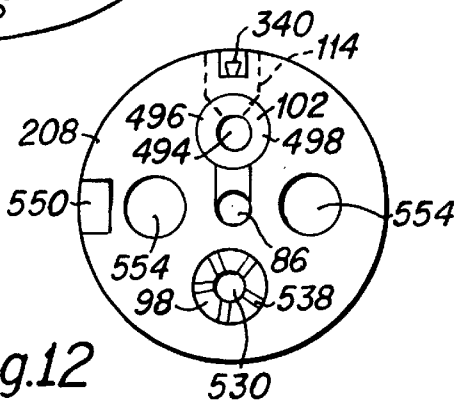
FIG. 12 is an end elevational view of the valve manifold of the pump head depicted in FIG. 11.

Detailed features of the manifold 208 are now further described with the aid of FIGS. 11, 12 and 13, wherein FIG. 11 includes a side cross-sectional view of the manifold 208, FIG. 12 is an end elevational view of the manifold 208 and FIG. 13 is a plan view of the gasket member 430. As depicted in FIGS. 11, 12 and 13 the manifold 208 includes an internally threaded axial bore 254 having O-ring seal 440 disposed therewith in or threaded engagement with the external threads 250 of the inner end 24 of the inner tube 22. An air passageway 86 is centrally axially formed through the manifold 208 to communicate pumped air passing through the inner tube 22 to the air passageway 86 of the spindle 300. A second pumped air outlet passageway 494 is formed through the manifold 208 parallel to the central passageway 86. The passageway 494 includes a widened valve cavity portion 496 having a flat shoulder 498 for an air seal engagement with valve disk 352 disposed within the outer end 496 of the passageway 494. The valve disk 352 thus permits pumped air to pass out of the passageway 494 and prevents air from passing back into the passageway 494 by sealing operation of the valve disk 352 with the flat shoulder 498. A radially inwardly projecting air passage slot 106 is formed in the valve cavity 496 and in the outer face of the manifold 208 to provide a pneumatic air passageway for pumped air passing through valve 102 to flow into central air passageway 86, and thereafter through the valve head 18. It is to be understood that rearwardly projecting valve control members 348 formed on the inner surface 344 of the spindle 300 project into the valve space 102 to interact with the valve disk 352 to form the one way valve 102.

A mode switch air passageway 114 projects radially into the manifold 208 to intersect with the air passageway 494. The passageway 114 includes cone-shaped sidewalls 510 that create an increased diameter outer passageway portion 514 in which the ball valve 420 resides. The outer surface of the ball 420 forms an air tight seal with the cone shaped walls 510 of the passageway 114 when the ball 420 is pressed into engagement with the walls 510. An air passage slot 520 is formed in the outer surface of the manifold 208 to communicate air from the passageway 114 past the ball 420 and outwardly into hook slot 490 and thereafter outwardly through the air inlet slot 366 formed in the outer edge of the head body member 360. It is therefore to be understood that when the manifold 208 is properly disposed within the valve head body member 360, that the ball engagement projection 412 of the hook switch 340 will engage the outer surface of the ball 420 and urge it downwardly in a air sealing engagement with the cone shaped surface 510 of the air passageway 114. In this configuration, pumped air will pass through passageway 494 and through valve 102 and outward through the pump head 18. Conversely, when the mode switch 120 is depressed forwardly, the ball engagement projection 412 will no longer urge the ball 420 into its air sealing engagement with the cone shaped sidewalls 510 of the air passageway 114. In this configuration, when air pressure on the pump outlet side of the disk 352 is greater than ambient air pressure on the outer side of the ball 420, the compressed air from the pump passing through passageway 494 will displace the ball 420 upwardly, whereupon the pumped air in passageway 494 will pass past ball 420 and into air passageway 520 for exhaust through the air inlet slot 366 as discussed above. The operation of the mode switch 120 in association with ball valve 420 is discussed further herebelow with the aid of FIGS. 17–22.

A third air passageway 530 is formed through the manifold 208 parallel to the central passageway 86 for inletting air through the manifold and into the inner low pressure air chamber 94 of the pump 200. The passageway 530 includes a widened valve end cavity 534 having projecting one-way valve control members 538 formed therein. An rearwardly projecting flat shoulder portion 346 formed on the inner surface 344 of the spindle 300 projects into the valve cavity 534 to interact with the valve disk 350 to form the one-way valve 98. An air passageway 544 formed through the shoulder 346, pneumatically communicates with the air inlet slot 366 formed in the outer edge of the head body member 360. Thus, ambient air may be drawn through the air inlet slot 366 and through the passageway 544 in the spindle 300 and through the one-way valve 98 and air passageway 530 and into the pump air chamber 94. Conversely, when the pump 200 is compressed, the disk 350 of the one-way valve 98 sealingly engages the flat shoulder 346 to prevent air exhaust through passageway 530. As indicated above, air exhaust from chamber 94 is accomplished through passageway 494 and one-way valve 102, or air passageway 114 if the mode switch 340 is positioned to allow the ball 420 to move upwardly.

As is best seen in FIG. 12, a manifold alignment notch 550 is formed in the outer surface of the manifold 208 to slidably mate with the alignment rib 464 formed in the inner surface of the head body member 360. Two round gasket alignment projections 554 project outwardly from the face of the manifold 280 to effect alignment of the manifold gasket 430 depicted in FIG. 13. As depicted in FIG. 13, the gasket 430 includes an alignment notch 560 in its peripheral edge for alignment with the notch 550 of the manifold 280 and alignment with the rib 464. Two circular alignment holes 564 facilitate alignment with the alignment projections 554 of the manifold face. A round hole 568 is provided in the gasket 430 for alignment within the air inlet valve 98. A keyhole shaped opening 574 is formed in the gasket 430 such that the enlarged end 578 seals the one-way valve 102, the smaller end 582 seals the central air passage 86 and the neck portion 586 seals the air passageway 106 between the valve 102 and the air passageway 86. It is therefore to be understood that the gasket 430 provides an air tight seal between the spindle 300 and the manifold 208 while allowing air to communicate through the various passageways.

Figure 14:
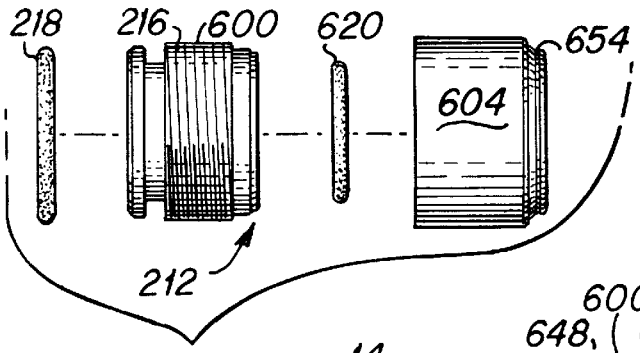
FIG. 14 is an assembly drawing of the outer tube end cap of the pump depicted in FIG. 9.
Figure 16:
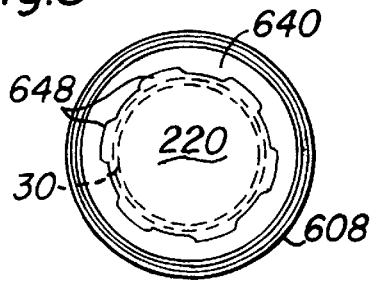
FIG. 16 is an end elevational view of the end cap depicted in FIG. 14.
Figure 15:
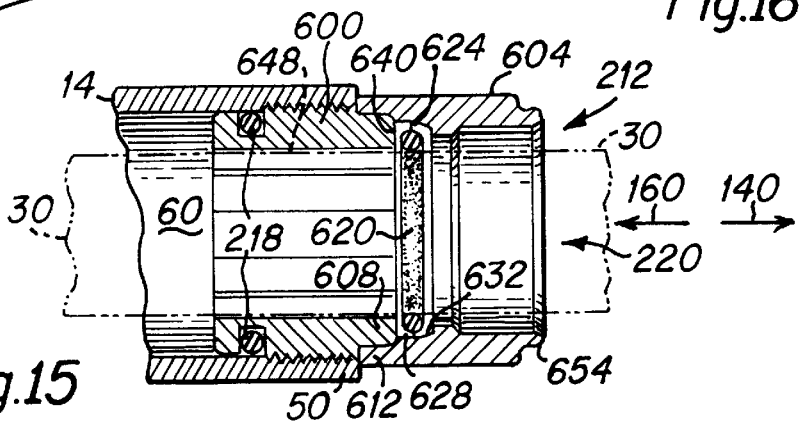
FIG. 15 is a side cross-sectional view of the end cap depicted in FIG. 14.

A further significant feature of the pump 200 is the one-way valve 54 disposed at the outer end 50 of the outer tube 14. FIGS. 14–16 are provided for comprehension of the valve 54 within the end cap 312 as is next discussed.

FIG. 14 presents an assembly drawing of the end cap 212 depicted in FIG. 9, FIG. 15 is a cross-sectional view of the assembled end cap, and FIG. 16 is an end clevational view of the end cap. As depicted in FIGS. 14, 15 and 16, the end cap 212 includes an inner end cap member 600 and an outer end cap member 604, and a middle tube bore 220 is formed through the inner cap member 600 and the outer cap member 604. The inner cap member 600 has external threads 216 for threaded engagement with internal threads 606 formed in the outer end 50 of the outer tube 14. The engagement of the inner cap member 600 with the outer cap member 604 is accomplished by forming a recessed shoulder 608 in the outer surface of the inner cap member 600 that mates within the projecting end 612 of the outer cap member 604. An air tight engagement, such as is accomplished by ultrasonic welding, joins the portions 608 and 612 together. An internal O-ring seal 620 is disposed within a seal holding chamber 624 within the outer cap member 604. The chamber 624 is formed with sidewalls having an inner portion 628 that is generally parallel to the central axis of the end cap and an internally sloping outer sidewall portion 632 which is disposed to make an air tight seal with the outer surface of the O-ring during portions of the pump operation. The inner wall 640 of the O-ring chamber 624 is formed by the face 640 of the inner cap member 600. As is best seen in FIG. 16, the face 640 includes a plurality of outwardly projecting air gaps 648 which are formed in the inner surface of the middle tube bore 220. It is therefore to be understood that when the middle tube 30 (shown in phantom) is inserted within the bore 220 that the O-ring seal 620 will expand outwardly such that it makes an air tight seal with the outer surface of the middle tube 30. When the middle tube 30 is pushed in a compression stroke direction 160, the O-ring will move in the direction 160 to make contact with the inner chamber face 640. Due to the gaps 648 formed in the face 640, the O-ring 620 will not form an air tight seal against the face 640, and air will pass through the gaps 648 and through the inner cap member 600 and thus into the outer air chamber 60 between the middle tube and the outer tube. Conversely, when the middle tube is extended outwardly in direction 140 the O-ring 620 will also move outwardly in direction 140 until the surface of the O-ring 620 makes contact with the inwardly sloped sidewall 632 of the chamber 628, whereupon the O-ring will form an air tight seal against the sidewall 632. Thus, the O-ring 620 in cooperation with the walls of the chamber 624 functions as a one-way air valve within the end cap 212. Lastly, the outboard end 654 of the outer end cap member 604 is formed with a radially projecting flange, which is adapted for mating engagement with a mirroring flange formed on the inner edge 658 of the handle 42, such that the handle 42 is releasably engagable with the end cap 212.

Figure 17:
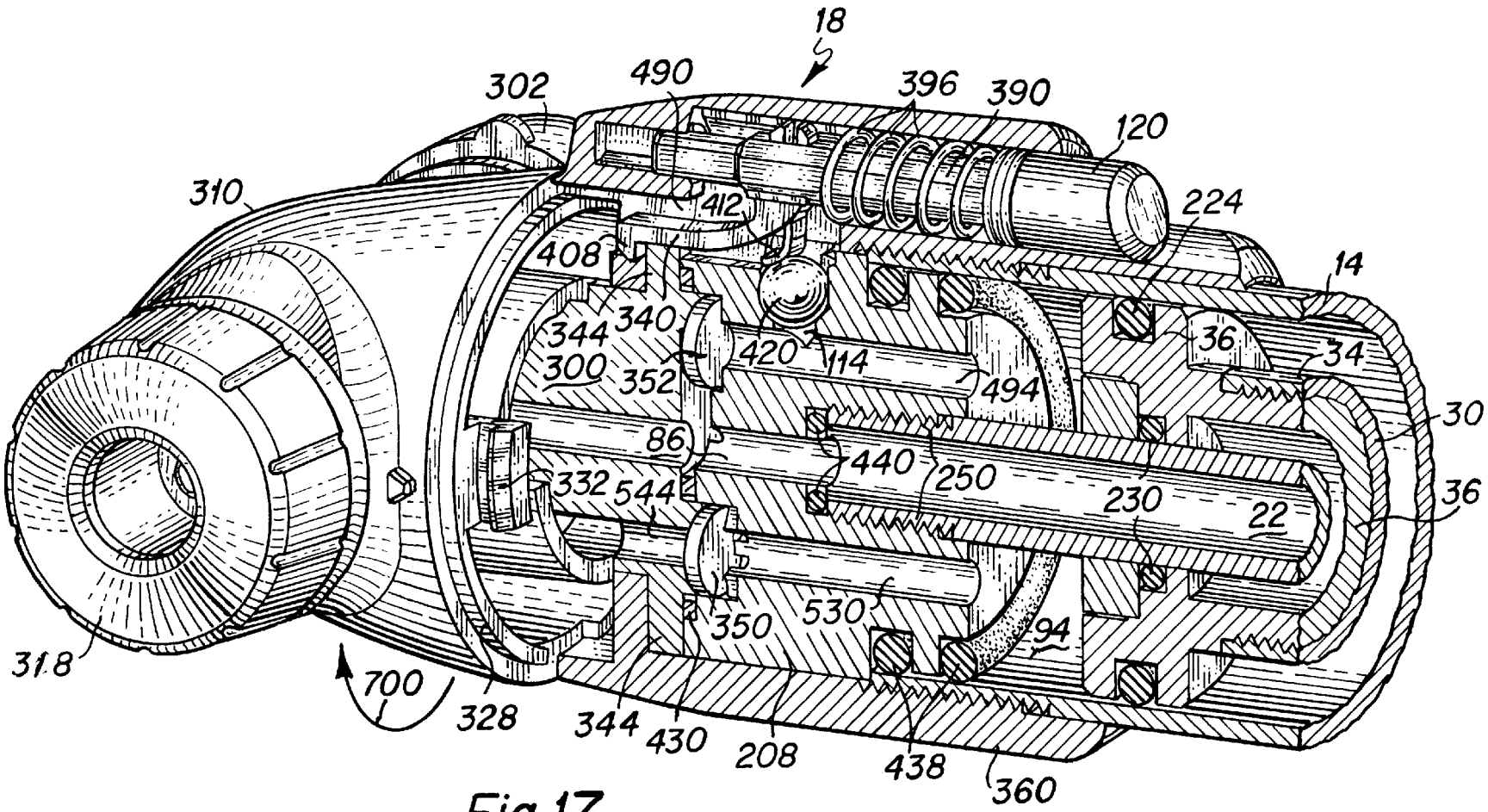
FIG. 17 is a perspective view with cutaway portions of the pump head of the pump depicted in FIG. 11.

FIGS. 17–22 are perspective views having cutaway portions that depict the operation of the mode switch as incorporated within the two-headed pump of the preferred embodiment 200. As depicted in FIG. 17, the head 18 of the pump 200 includes the two valve outer housing 310, the head body member 360 and the manifold 208. The outer tube 14 is threadably engaged within the head body 360 and the inner tube 22 is likewise threadably engaged within the manifold 208. The middle tube is shown disposed between the outer tube 14 and the inner tube 22. The middle tube piston member 36 includes the outer O-ring seal 224 and the inner O-ring seal 230.

With regard to the mode switch 120, in FIG. 17 it is depicted in its rearward orientation, such that the projecting hook portion 408 of the hook switch 340 is mechanically/ frictionally engaged upon the outwardly projecting shoulder 344 of the spindle 300. In this configuration, the valve ball engagement member 412 presses against the valve ball 420 and holds it downwardly within the air passageway 114. It is to be understood that the orientation of the mode switch depicted in FIG. 17 is generally identical to the orientation of the mode switch depicted in FIG. 11.

FIG. 17 provides further detail with regard to the flange hook 332 of the housing 310. Specifically, as depicted in FIG. 17, the flange hook 332 projects outwardly from the rearward flange portion 328 of the housing 310. It is important to note that the hook 332 is formed as a short arcuate section rather than as a projecting flange that extends outwardly around the entire circumference of the flange 328. As has been indicated hereabove, the housing 310 is rotatable relative to the body portion 360, and arrow 700 in FIG. 17 denotes a first rotational direction of the housing 310 relative to the body 360 of the pump 200.

Figure 18:
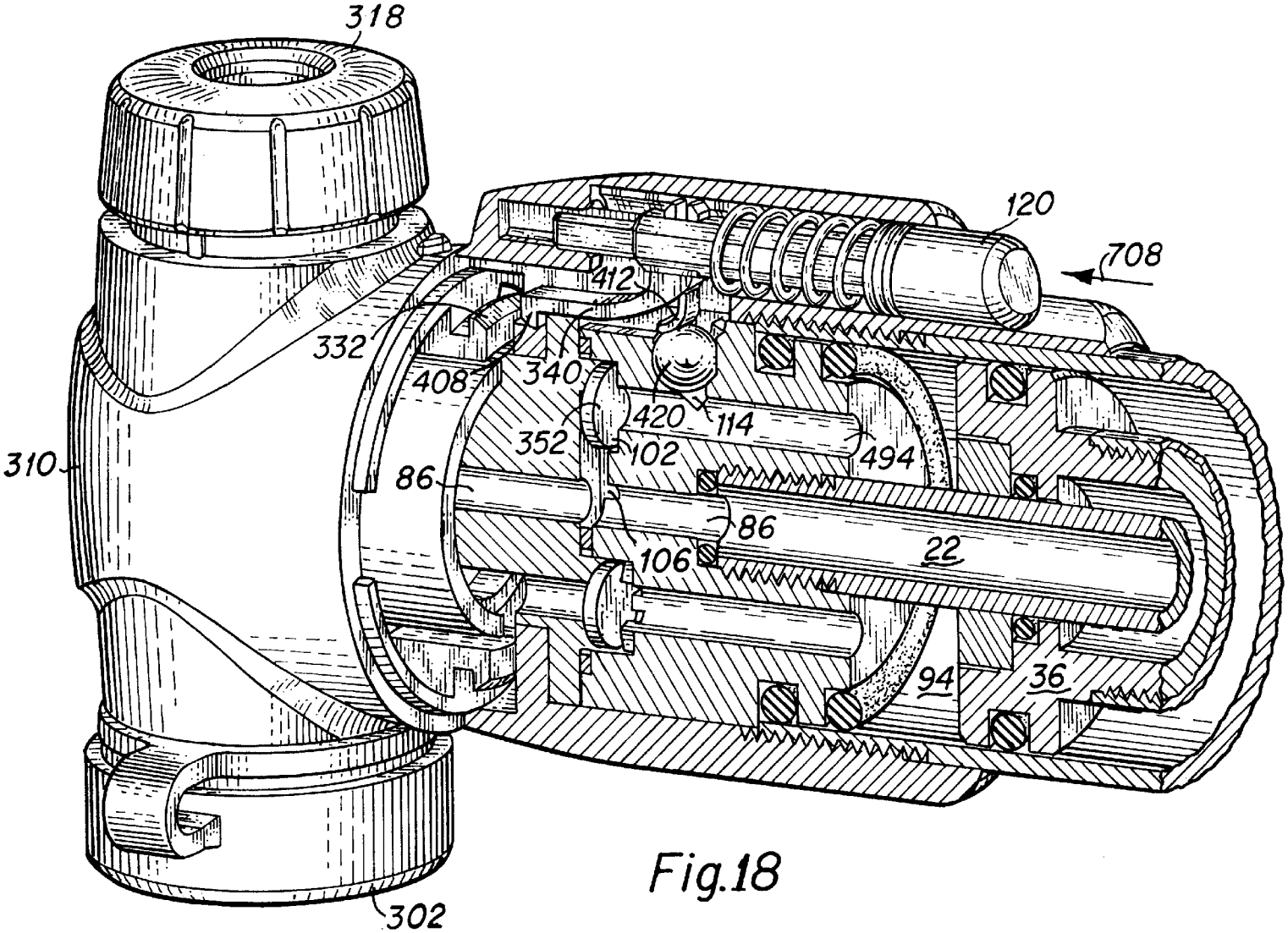
FIG. 18 is a further perspective view of the pump head depicted in FIG. 17.

As depicted in FIG. 18, the outer housing 310 has been rotated 700 through an angle of approximately 90° relative to its depiction in FIG. 17. In this orientation, the hook 332 is aligned forwardly of the projecting, hook 408 of the hook switch 340. The pump head orientation depicted in FIG. 18 is now identical to that depicted in FIG. 11. That is, the valve spindle seal 320 is aligned with one of the output valves, such as the Presta valve adaptor 308, to output pumped air from the pump 200. In this orientation, as has been discussed hereabove, the pump is operated by the user and air from the low pressure chamber 94 is pumped through passageway 494 and through valve 102; simultaneously, air is pumped from the high pressure chamber 80 through the inner tube 22 and air passageway 86. When the air pressure in the pneumatic article engaged to the pump rises to the level that it becomes difficult for the user to operate the pump, the mode switch 120 is depressed forwardly (arrow 708 in FIG. 18) to operate the mode switch as is depicted in FIG. 19 and next discussed.

Figure 19:
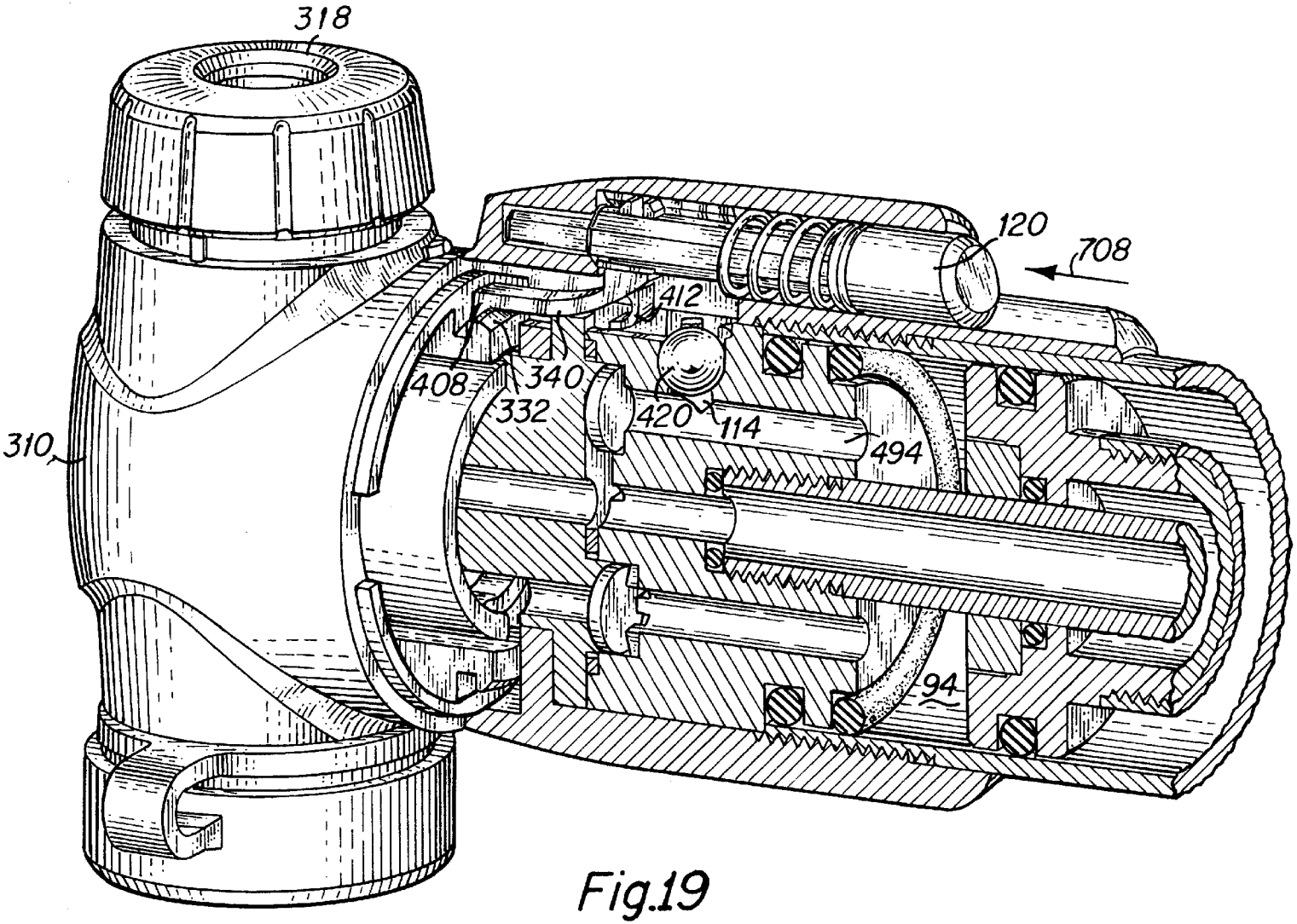
FIG. 19 is a further perspective view of the pump head depicted in FIG. 18.
Figure 20:
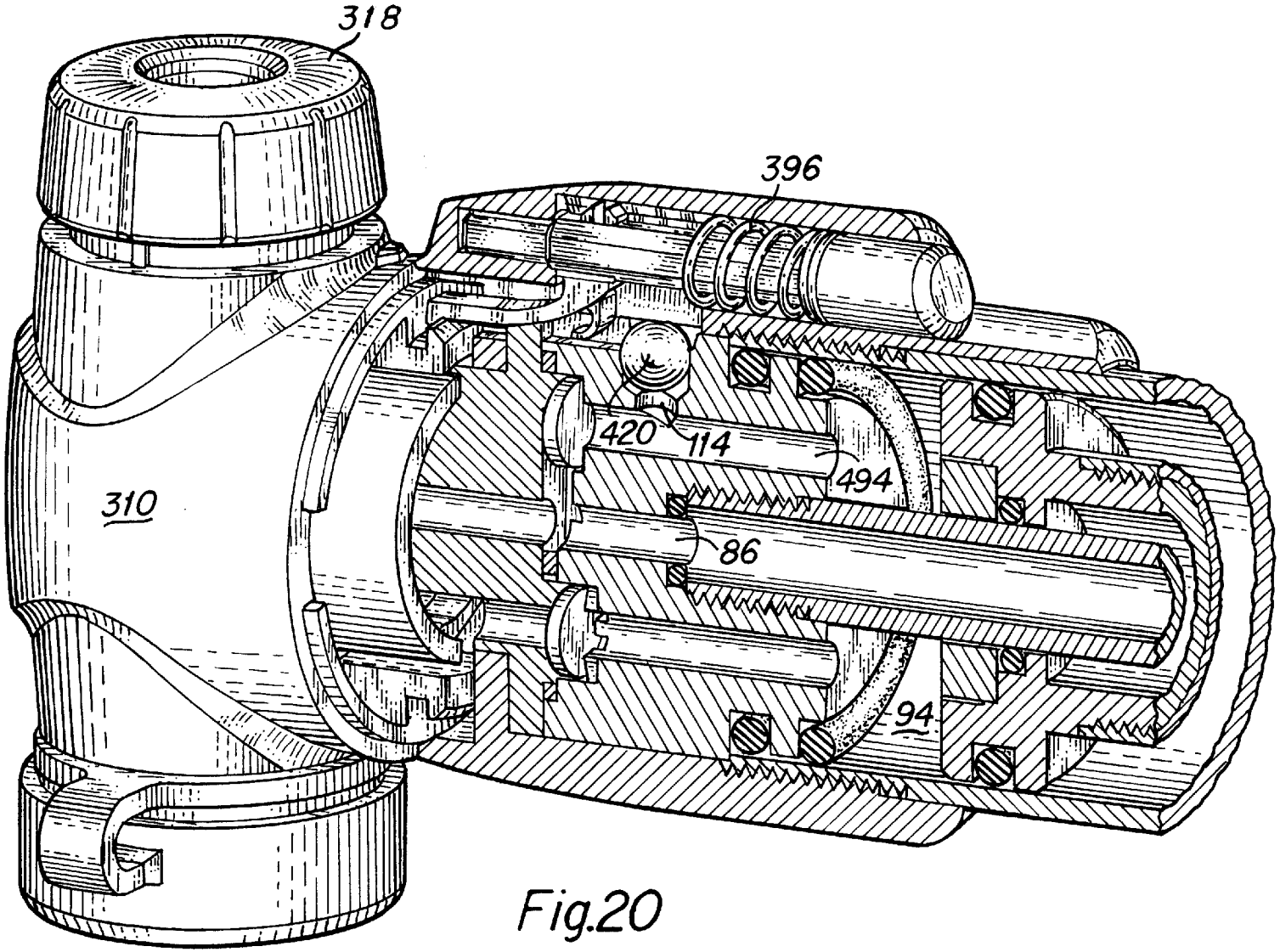
FIG. 20 is a further perspective view of the pump head depicted in FIG. 19.

As depicted in FIG. 19, when the mode switch 120 is depressed forwardly 708 the forwardly projecting hook 408 of the hook switch 340 moves forwardly and becomes mechanically engaged with the flange hook 332. In this orientation, the ball engagement projection 412 moves forwardly and no longer depresses the valve ball 420 into the air passageway 114. Thereafter, as depicted in FIG. 20, when the pump is operated further, air that is compressed in the low pressure chamber 94 will move through passageway 114 lifting the ball 420 upwardly (as depicted in FIG. 20), such that air will pass out of passageway 494 through passageway 114 and out to the ambient environment as has been described hereabove. In this low volume, high pressure mode, only air from chamber 80 is pumped into the pneumatic article attached to the pump.

Figure 21:
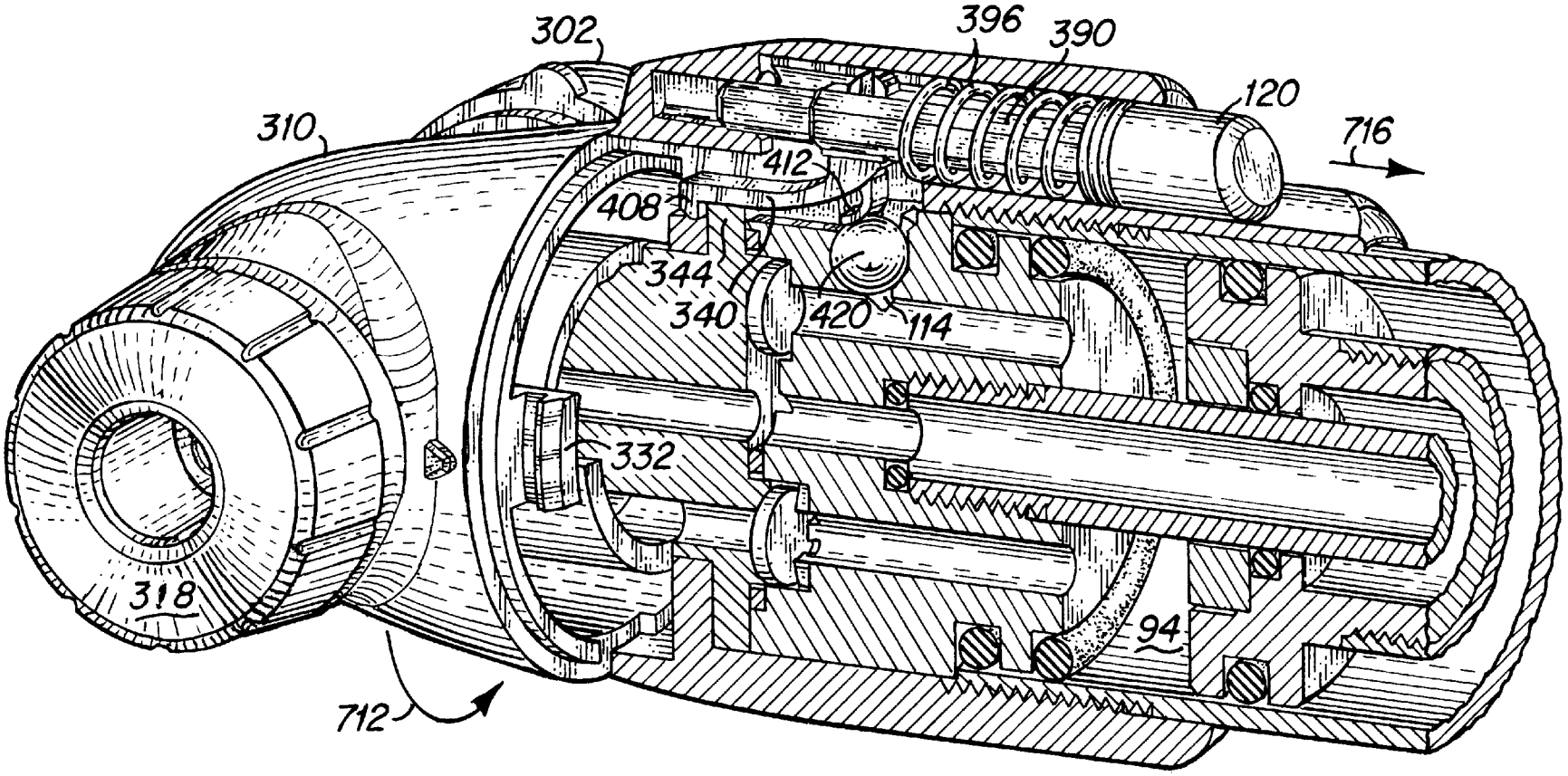
FIG. 21 is a further perspective view of the pump head depicted in FIG. 20.

When the pneumatic article has been pumped to its desired high pressure the pump housing 310 is rotated 712 back to the storage position as depicted in FIG. 21, and the pump 200 is removed from its engagement with the pneumatic article. After the outer housing 310 has been rotated 712, the flange hook 332 has also been rotated out of its engagement with the projecting hook end 408 of the hook switch 340. When the outer housing 310 is so rotated, the mode switch spring 396 urges the mode switch 120 rearwardly 716 and the ball engagement projection 412 again engages and depresses the valve ball 420 into the air passageway 114 to seal it. The extending hook 408 makes a hooked mechanical/frictional engagement with the projecting flange 344 of the spindle 300 to halt the rearward motion of the mode switch 120. It is thus to be understood that the pump, as depicted in FIG. 21 has been thus returned to its starting configuration as depicted in FIG. 17.

It will be appreciated by those skilled in the art, that the selectable interaction of the projecting hook end 408 of the hook switch 340 with the projecting flange hook 332 is a special case designed for an outer housing 310 that is rotatable because it has two valve heads. It is contemplated by the inventors that the present invention is easily adapted for pumps having fixed outer housings which have but a single output valve. In such an instance, a flange hook member can be formed utilizing a separate movable, rotatable or depressable member to which the flange hook is engaged.

It is understood by the inventors that those skilled in the art will no doubt develop other and further alterations and embodiments of pumps having selectable mode switches, and it is the intention of the inventors that the following claims cover all such alterations and modifications in pump embodiments that nevertheless include the true spirit and scope of the invention.

What I claim is:

1. A dual mode air pump, comprising:

a pump head;

an outer tube being fixedly engaged to said pump head;

an inner tube being fixedly engaged to said pump head;

a middle tube being slidably engaged to said outer tube end and said inner tube;

a pump mode switch being operable to cause said pump to change from a low pressure, high volume mode to a high pressure, low volume mode.

2. A pump as described in claim 1 wherein said mode switch is disposed within said pump head.

3. A pump as described in claim 1 wherein a low pressure chamber is formed within said outer tube and a high pressure chamber is formed within said middle tube.

4. A pump as described in claim 3 wherein said mode switch is pneumatically connected to said low pressure chamber.

5. A pump as described in claim 3 wherein an outer air chamber is formed between said outer tube and said middle tube and an inner air chamber is formed between said middle tube and said inner tube, and wherein an air passage pneumatically connects said outer chamber with said inner chamber.

6. A pump as described in claim 5 wherein air from said outer chamber and said inner chamber is transferred into said high pressure chamber during operation of said pump.

7. A pump as described in claim 6 wherein the total expanded volume of said outer chamber plus said inner chamber is substantially greater than the expanded volume of said high pressure chamber.

8. A pump as described in claim 1 wherein one-way air inlet valve is disposed at an outer end of said outer tube.

9. A pump as described in claim 3 further including a one-way air inlet valve to inlet air into said low pressure chamber from the ambient environment.

10. A pump as described in claim 9 further including a one-way valve to outlet air from said low pressure chamber into an air passageway that is pneumatically connected to a pumped air outlet of said pump head.

11. A pump as described in claim 2 wherein a pump handle is engaged to an outer end of said middle tube.

12. A dual mode pump comprising:

a pump head;

a plurality of air pump tubes, at least one of which is slidably engagable relative to another;

a pump mode switch being engaged within said pump head, said mode switch including:

an air passageway being formed in said pump head to output air from said pump to the ambient environment;

a valve element being disposed within said air passageway;

a valve element switch being disposed in said pump head and operable to selectively cause said valve element to seal said passageway against air passage therethrough or unseal said passageway to allow air passage therethrough.

13. A pump as described in claim 12 wherein said valve element includes a ball valve member.

14. A pump as described in claim 12 wherein said switch includes a hook portion being selectively disposable to engage a hooked member within said pump head, to cause said hook to be selectively oriented in a valve closed orientation and a valve open orientation.

15. A pump as described in claim 14 wherein said hooked member is engaged to a movable member disposed within said pump head.

16. A pump as described in claim 15 wherein said pump head includes a two-headed pump housing member and said hooked member is engaged to said housing member.

17. A pump as described in claim 12 wherein said pump includes an outer tube, a middle tube and an inner tube.

18. A pump as described in claim 17 wherein said outer tube is fixedly engaged to said pump head, said inner tube is fixedly engaged to said pump head, and said middle tube is slidably engaged to both said outer tube and said inner tube.

19. A pump as described in claim 18 wherein a low pressure chamber is formed within said outer tube and a high pressure chamber is formed within said middle tube.

20. A pump as described in claim 19 wherein said mode switch is pneumatically connected to said low pressure chamber.

21. A pump as described in claim 19 wherein an outer air chamber is formed between said outer tube and said middle tube and an inner air chamber is formed between said middle tube and said inner tube and wherein an air passage pneumatically connects said outer chamber with said inner chamber.

22. A pump as described in claim 21 wherein air from said outer chamber and said inner chamber is transferred into said high pressure chamber during operation of said pump.

23. A pump as described in claim 22 wherein the total expanded volume of said outer chamber plus said inner chamber is substantially greater than the expanded volume of said high pressure chamber.

24. A pump as described in claim 18 wherein an one-way air inlet valve is disposed at an outer end of said outer tube.

25. A pump as described in claim 19 further including a one-way air inlet valve to inlet air into said low pressure chamber from the ambient environment.

26. A pump as described in claim 25 further including a one-way valve to outlet air from said low pressure chamber into an air passageway that is pneumatically connected to a pumped air outlet of said pump head.

* * * * *